United States Patent [19]

Rifkin

[11] Patent Number: 4,660,874

[45] Date of Patent: Apr. 28, 1987

[54] GUSSET TYPE SLIDE FASTENER SEAL

[76] Inventor: Arnold S. Rifkin, 1400 Sans Souci Pkwy., P.O. Box 878, Wilkes-Barre, Pa. 18703-0878

[21] Appl. No.: 834,540

[22] Filed: Feb. 28, 1986

[51] Int. Cl.[4] ..... B65D 33/34

[52] U.S. Cl. ..... 292/307 R; 24/387

[58] Field of Search ..... 292/307 R, 307 B, 281, 292/282, 285, 286, 205, 104; 70/68, 56; 24/387, 418, 429, 436

[56] References Cited

U.S. PATENT DOCUMENTS

| | | | |
|---|---|---|---|
| 688,747 | 12/1901 | McMillen | 292/281 |
| 934,229 | 9/1909 | Stamm | 292/285 |
| 1,312,931 | 8/1919 | Tenny et al. | 292/205 |
| 1,759,283 | 5/1930 | Schmidt | 70/68 |
| 1,950,414 | 3/1934 | Rifkin | 70/68 |
| 3,653,236 | 4/1972 | Kerr | 24/387 |
| 3,955,842 | 5/1976 | Edwards | 292/307 R |
| 4,008,914 | 2/1977 | Anderson | 292/307 R |
| 4,031,724 | 6/1977 | Atkinson | 70/68 |

*Primary Examiner*—Richard E. Moore

*Attorney, Agent, or Firm*—Robert K. Youtie

[57] ABSTRACT

A seal for use with a container having a flexible gusset sheet or the like including a pair of slide fastener runner tapes, releasably interengageable grippers on the tapes, a slider moveable along the tapes toward one end thereof for interengaging the grippers and in the opposite direction for releasing the grippers, a slider pull or tab carried by the slider, a cover configured to conformably cover the slider pull when the grippers are closed, the cover being mounted to the sheet for movement into and out of its covering relation to the slider pull, and registerable openings in the slider pull and cover for receiving therethrough a sealing shackle when the grippers are interengaged.

8 Claims, 4 Drawing Figures

GUSSET TYPE SLIDE FASTENER SEAL

BACKGROUND OF THE INVENTION

As is well known to those versed in the art, there are many constructions of security containers or bags having slide fastener closures or zippers which it is desirable to seal or securely lock with little skill or effort, and at a minimum of expense. Particular difficulties have been experienced in locking and sealing zippers carried on flexible gusset sheets or large walls, say of a three dimensional bag.

Applicant is aware of the below listed prior art:

| U.S. PAT. NO. | PATENTEE |
|---|---|
| 1,078,928 | KEMPER |
| 1,123,997 | DUEPNER, JR. |
| 1,230,073 | MORGAN |
| 1,508,384 | DRAKE |
| 2,569,076 | SCHAYE |
| 2,578,035 | BASHOVER |
| 2,677,952 | STUE |
| 3,141,536 | FULTON |
| 3,276,086 | REESE |
| 3,971,458 | KOENIG |
| 4,062,090 | MOOLENAARS |
| 3,990,130 | HATTORI |

The prior art indicates the problem of making a slide fastener or zipper closure secure, and illustrates many approaches toward this end.

SUMMARY OF THE INVENTION

It is an important object of the present invention to provide a seal construction for a slide fastener or zipper applied to a flexible gusset or wall of a container which is of greatly enhanced security, for use with a padlock for pilfer proofing, or a flexible shackle for tamper detection; which seal is extremely economical to incorporate in a bag or the like, requiring essentially only a single riveting operation; quick and easy to use by unskilled persons, and which affords the selective alternative of either a padlock, flexible shackle seal, or both, if so desired.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

DESCRIPTION OF THE PREFERRED EMBODIMENT

Figure 1:
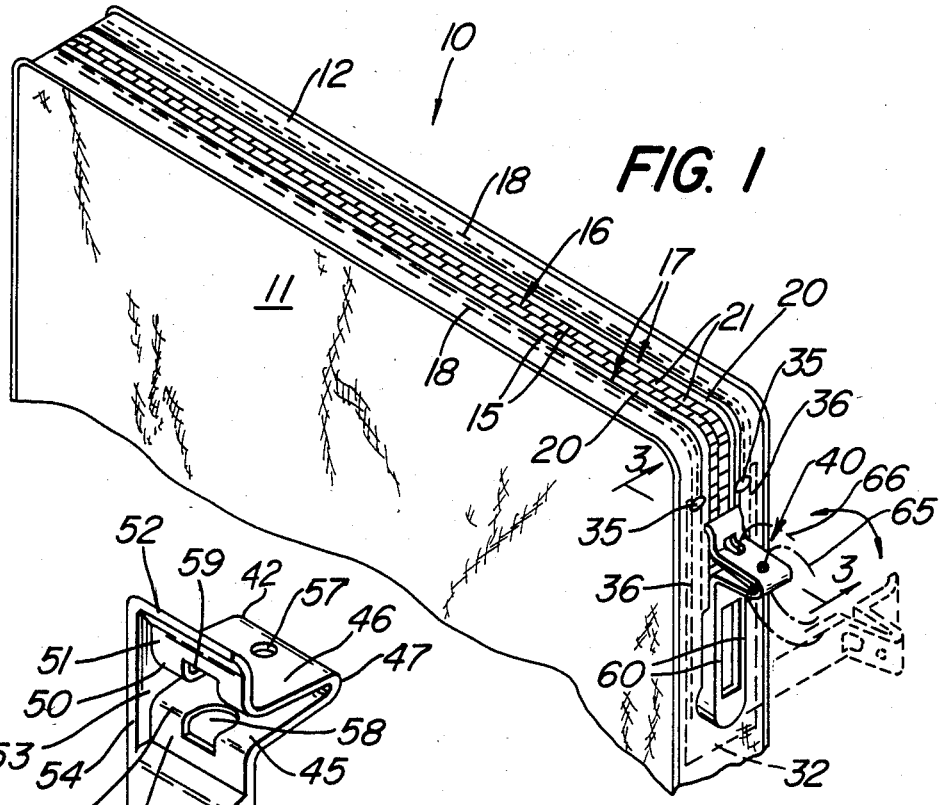
FIG. 1 is a top perspective view showing a gusseted bag having a slide fastener lock or seal constructed in accordance with the present invention, an alternate position of the seal being shown in phantom.

Referring now more particularly to the drawings, and specifically to FIG. 1 thereof, a flexible walled bag or container is there generally designated 10, including a pair of facing spaced side walls 11, say of congruent, generally rectangular configuration, and a peripheral edge wall or gusset 12 extending circumferentially about and enclosing the space between the side walls. The side walls 11 and peripheral wall or gusset 12 may all be fabricated of flexible sheet material, such as wovern fabric, or the like, suitably reinforced as desired, and conventionally secured together, as by stitching, or other securing means.

The peripheral wall or gusset sheet 12 is formed therealong with an opening or slot defined between adjacent gusset edges 15, to which is secured a slide fastener or zipper 16.

The slide fastener 16 includes a pair of longitudinally coextensive runners 17, each extending along a respective edge 15 of the gusset 12 and secured thereto, as by stitching 18, or other suitable means. The runners 15 may each include an elongate strip or tape 20, which is stitched to the gusset 12 extending along and projecting beyond a respective gusset edge 15. On the extending, longitudinal edge of each tape 20 are teeth or other grippers 21, the grippers of one tape being moveable into and out of releasable interengagement with the grippers of the other tape, in the manner of a slide fastener.

Figure 3:
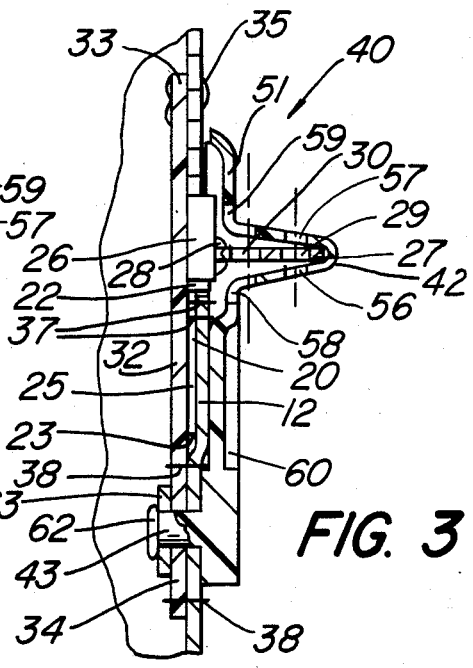
FIG. 3 is a partial sectional view taken generally along line 3—3 of FIG. 1.

The grippers 21 of the respective tapes 20 are longitudinally coextensive with each other and terminate at a location, see 22 in FIG. 3, short of the adjacent ends 23 of the tapes 20. Thus, the tape end portions 25 beyond the gripper ends 22 define anchoring extensions or tails on the tapes, as will appear more fully hereinafter.

A slider 26 is shown on the grippers 21, in FIG. 3, in the limiting position on the grippers in which the slide fastener 16 is closed. The slider is, of course, slidable out of the closed position shown in FIG. 3, upwardly, to open the slide fastener. Carried by the slider 26 is a slider pull or tab 27, which may be swingably connected to the outer side of the slider, as by a pull connection or loop 28. Thus, the slider pull 27 is swingable relative to the slider 26 to project therefrom, generally normal to the slider (as shown in FIG. 3), and is further swingable in opposite directions to lie generally longitudinally along and on top of the slider.

A pair of through holes or apertures 29 and 30 are formed in slider pull 27, for a purpose appearing presently.

A relatively stiff backing member or plate 32 is located on the inner side of the gusset sheet 12 in the region of the gripper ends 22, the backing member or plate being advantageously of plastic, or other suitably stiff reinforcing material capable of being riveted and sewn. The backing member or plate extends laterally beyond and overlies the tapes 20 in the region of the gripper ends 22, while terminating laterally short of the bag side walls 11. In addition, the backing member or plate 32 extends longitudinally of the slide fastener inwardly or upwardly beyond the gripper ends 22 to an inner end region 33, and extends downwardly or outwardly beyond the tapes 20 and the tape extensions 25 to an outer end region 34. The backing plate 32 may be generally rectangular in outline configuration as seen in FIG. 1, and may have its inner end region fixedly secured to the gusset sheet 12, as by a pair of headed fasteners 35, on opposite sides of the gusset edges 15. That is, the fasteners 35 may each extend through and securely fasten one corner of the backing plate 32 to one tape 20, and the overlying portion of gusset sheet 12.

Additional backing member securing means, such as stitching 36 extends generally from the region of the gripper ends 22 along each side edge of the backing member 32, longitudinally or downwardly, through the backing member, the overlying portion of gusset sheet 12, and the intermediate tape extensions or tails 25. There are advantageously provided additional lines of securement or stitching extending transversely between the laterally spaced stitching 36, as the stitching 37 adjacent to and longitudinally outwardly of the gripper ends 22, and the stitching 38 longitudinally outwardly beyond and remote from the gripper ends 22. The transverse securement means or stitching 37 passes through the gusset sheet 12 and underlying tape extensions 25, while the transverse stitching 38 extends through the gusset sheet 12 and the underlying backing member or plate 32.

From the foregoing, it will be appreciated that the backing member or plate 32 is effectively secured to the under or inner side of the gusset sheet 12 and the slide fastener 16 in the region of the gripper ends 22, to effectively rigidify and reinforce the same. Further, the tape extensions 25 are both clamped between the gusset sheet 12 and reinforcing member 32 and secured thereto, for effective anchoring therebetween.

In addition to the foregoing structure, there is provided a slide fastener seal, generally designated 40, which may advantageously be integrally fabricated, say of plastic, by molding, but may be formed otherwise of other materials, if desired. The seal 40 includes an elongate member or arm 41, of generally rectangular cross section, having at one end a slider pull cover or receiver 42, and having at its other end a transverse pivot, pin or rivet 43.

The cover or receiver 42 outstands from the arm 41, generally normal thereto, being defined essentially by a pair of generally parallel, facing, spaced walls 45 and 46, the former being more proximate to the arm 41 and the latter being more remote from the arm.

Figure 2:
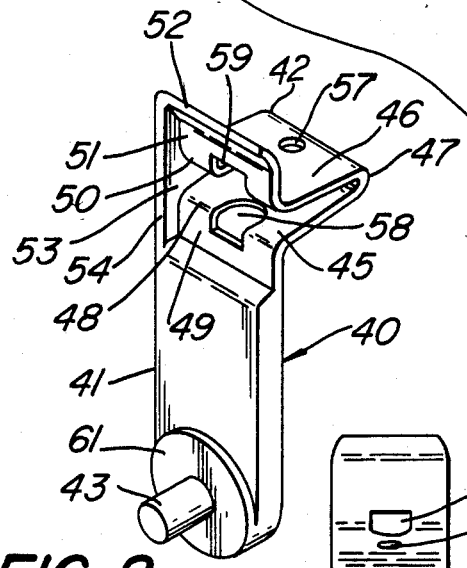
FIG. 2 is a perspective view showing the seal of the present invention apart from the bag.
Figure 4:
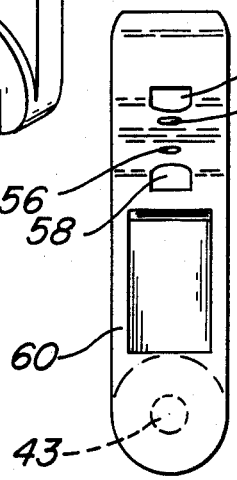
FIG. 4 is an external elevational view of the seal, as taken from the right in FIG. 3.

The receiver walls 45 and 46 may be somewhat outwardly convergent in the direction away from the plane of the arm 41, there being joined together by a laterally coextensive arcuate or bight portion 47. The inner end region of the proximate receiver wall 45 is sharply bent, as at 48 into an extension 49 generally coplanar with and merging integrally into the adjacent portion of the arm 41. As the wall portion 49 is of less thickness than the arm 41, the wall portion is recessed into or offset outwardly from the inner side of the arm, as best seen in FIG. 2. The more remote receiver wall 46 is similarly sharply curved at its inner end, at bend 50 and extends therefrom longitudinally outwardly of the arm 41 by wall portion 51, which is generally coplanar with inwardly extending wall portion 49. In addition, an inturned lip or flange 52 is formed on the distal end of wall portion 51. A closure or wall 53 extends between one adjacent pair of side edges of walls 45 and 46, the far side edges as seen in FIG. 2, the closure wall 53 extending generally from the bight 47 to an edge 54 extending between and approximately flush with the edge 52 and the inner surface of arm 41.

Thus, the cover 42 is composed of the facing, spaced walls 45 and 46, joined at their extremities by bight 47, and closed along one side or edge by wall 53, the other side or edge being entirely open, as seen in FIG. 2.

Adjacent to the bight portion 47, the cover walls 45 and 46 are formed with a pair of aligned through openings 56 and 57; and, remote from the bight portion 47 the walls 45 and 46, and their respective extensions or wall portions 49 and 51, are formed with aligned through openings 58 and 59. The aligned openings 58 and 59 are larger than the aligned openings 56 and 57.

The arm 41 may have its outer surface reinforced, as by longitudinal ribs 60.

Additionally, the inner end region of the arm 41 may be strengthened by the provision of a boss or enlargement 61, on the inner side of the arm and surrounding the pin 43.

In assembly of the seal 40 with the bag 10, it is only necessary to provide a single hole for receiving the pin 43, which is then headed, as at 62 to define a pivot or rivet. More specifically, a hole is pierced through the lower or outer end region 34 of the reinforcing or backing plate 32, and the overlying portion of gusset sheet 12, through which is inserted the pin 43. An annular member or washer 63 may be engaged about the pin 43 before formation of the head 62.

It will now be appreciated that the seal 40 and the arm 41 are mounted to the bag 10, for rotation about the axis of pivot 43, which moves the receiver, and specifically the receiver walls 45 and 46 edgewise into and out of receiving or covering relation with respect to the pull tab 27 when the latter outstands from the slider 26. The seal receiving or covering relation is shown in full lines in FIG. 1, and is shown in uncovering relation in the phantom position.

When the receiver or cover 42 is in its covering relation with respect to the slider pull 27, the receiver apertures 56 and 57 are in registry with the pull aperture 29, and the receiver apertures 58 and 59 are in registry with the pull aperture 30. Thus, suitable shackle means may be extended through one or both sets of registering apertures, as shown in phantom at 65 and 66 in FIG. 1. In practice, the smaller registering apertures 56, 29 and 57 may conveniently receive a plastic, wire or other suitable seal, while the larger registering apertures 58, 30 and 59 may conveniently receive the shackle of a padlock, if desired.

The reinforcing member 32 effectively maintains proper positioning of the seal 40 with respect to the slide fastener 16 and specifically with respect to the slider 26 in its runner closing position at gripper ends 22.

From the foregoing it is seen that the present invention provides a slide fastener seal, particularly for gusseted and similar bags, which is extremely simple and economical to manufacture and assemble, and quick and easy in use by unskilled persons.

Although the present invention has been described in some detail by way of illustration and example for purposes of clarity of understanding, it is understood that certain changes and modifications ma be made within the spirit of the invention.

What is claimed is:

1. The combination with a slide fastener mounted to a gusset sheet or the like having a generally flat intermediate portion, said flat portion having an elongate opening between generally parallel sheet edges, a pair of longitudinally extending runner tapes along said edges of said sheet and generally coplanar with each other in facing engagement with said flat sheet portion, coextensive releasably interengageable grippers on said tapes terminating at one pair of adjacent gripper ends short of the adjacent pair of tape ends and in flat sheet portion, a slider moveable along said grippers toward said one ends thereof for interengaging the grippers and away from said one gripper ends to release the grippers, and a slider pull connected to the slider and adapted to stand out from said flat sheet portion; of a seal comprising a cover configured to conformably cover said slider pull when the latter is at said one gripper ends outstanding from said flat sheet portion, mounting means mounting said cover to said flat sheet portion for movement along said flat sheet portion into and out of position over said one gripper ends for respectively covering and uncovering said slider pull, said cover and pull respectively having openings registering with each other when said cover is in covering relation with said slider pull, for receiving a seal shackle through said registering openings.

2. The combination according to claim 1, said mounting means comprising a pivot extending generally normal to said tapes and said flat sheet portion, and an arm extending from said pivot for movement generally in the plane of said tapes, said cover being carried by said arm for said covering and uncovering relation with respect to said slider pull.

3. The combination according to claim 2, in combination with a stiff backing member fixed relative to said sheet and said adjacent tape ends in facing engagement with said tapes, said pivot being carried by said fixed backing member.

4. The combination according to claim 3, said pivot being spaced longitudinally of said grippers beyond said one gripper ends.

5. The combination according to claim 4, said cover comprising a pair of facing spaced walls generally parallel to said pivot and moveable edgewise into said slider pull covering and uncovering relation.

6. The combination according to claim 5, said arm being on the outer side of said sheet flat portion, and said backing member being on the inner side of said sheet flat portion, and said pivot extending through said sheet flat portion and backing member.

7. The combination according to claim 6, said adjacent pair of tape ends extending beyond said grippers and being anchored between said sheet and backing member.

8. The combination according to claim 6, said backing member extending in backing relation with said one gripper ends, to locate said slider relative to said pivot when said slider is at said one gripper ends to facilitate swinging said cover into and out of said covering relation.

* * * * *